US009359572B2

(12) United States Patent
Benecke et al.

(10) Patent No.: US 9,359,572 B2
(45) Date of Patent: Jun. 7, 2016

(54) MODIFIED VEGETABLE OIL LUBRICANTS

(75) Inventors: Herman Paul Benecke, Columbus, OH (US); Daniel B. Garbark, Blacklick, OH (US); Bhima Rao Vijayendran, Carlsbad, CA (US); Jeffrey Cafmeyer, Columbus, OH (US)

(73) Assignee: Battelle Memorial Institute, Columbus, OH (US)

( * ) Notice: Subject to any disclaimer, the term of this patent is extended or adjusted under 35 U.S.C. 154(b) by 0 days.

(21) Appl. No.: 13/256,094

(22) PCT Filed: Mar. 15, 2010

(86) PCT No.: PCT/US2010/000775

§ 371 (c)(1),
(2), (4) Date: Oct. 4, 2011

(87) PCT Pub. No.: WO2010/104609

PCT Pub. Date: Sep. 16, 2010

(65) Prior Publication Data

US 2012/0129746 A1 May 24, 2012

Related U.S. Application Data

(60) Provisional application No. 61/159,990, filed on Mar. 13, 2009.

(51) Int. Cl.

| | |
|---|---|
| ***C10M 105/42*** | (2006.01) |
| ***C10M 109/02*** | (2006.01) |
| ***C11C 3/00*** | (2006.01) |
| ***C11C 3/04*** | (2006.01) |
| *C11C 3/10* | (2006.01) |

(52) U.S. Cl.

CPC ..... *C10M 109/02* (2013.01); *C10M 105/42* (2013.01); *C11C 3/00* (2013.01); *C11C 3/04* (2013.01); *C10M 2207/301* (2013.01); *C10N 2230/02* (2013.01); *C10N 2230/08* (2013.01); *C11C 3/10* (2013.01)

(58) Field of Classification Search

CPC ..... C10M 129/66; C10M 2207/28; C10M 105/42; C10M 109/02; C10M 2207/031; C11C 3/00; C11C 3/04; C11C 3/10

USPC ..... 508/459

See application file for complete search history.

(56) References Cited

U.S. PATENT DOCUMENTS

| | | | |
|---|---|---|---|
| 2,813,113 | A | 11/1957 | Goebel |
| 3,024,260 | A | 3/1962 | Ernst |
| 3,437,437 | A | 4/1969 | Dorwart |
| 3,937,687 | A | 2/1976 | Rogier et al. |
| 4,032,565 | A | 6/1977 | Kilpatrick et al. |
| 4,055,606 | A | 10/1977 | Prevorsek et al. |
| 4,164,506 | A | 8/1979 | Kawahara |
| 4,205,115 | A | 5/1980 | Chang et al. |
| 4,242,254 | A | 12/1980 | Abolins |
| 4,242,309 | A | 12/1980 | Carduck |
| 5,075,046 | A | 12/1991 | Stoll |
| 5,126,170 | A | 6/1992 | Zwiener et al. |
| 5,324,794 | A | 6/1994 | Taka et al. |
| 5,520,708 | A | 5/1996 | Johnson |
| 5,534,425 | A | 7/1996 | Fehr et al. |
| 5,534,426 | A | 7/1996 | Karin et al. |
| 5,638,637 | A | 6/1997 | Wong et al. |
| 5,714,670 | A | 2/1998 | Fehr et al. |
| 5,763,745 | A | 6/1998 | Fehr et al. |
| 5,847,057 | A | 12/1998 | Kaplan et al. |
| 5,981,781 | A | 11/1999 | Knowlton |
| 6,130,297 | A | 10/2000 | Ramesh |
| 6,174,501 | B1 | 1/2001 | Noureddini |
| 6,248,939 | B1 | 6/2001 | Leto et al. |
| 6,362,368 | B1 | 3/2002 | Frische et al. |
| 6,420,490 | B1 | 7/2002 | DuBois |
| 6,448,318 | B1 | 9/2002 | Sandstrom |
| 6,455,715 | B1 | 9/2002 | Frische et al. |
| 6,479,445 | B1 | 11/2002 | Machac, Jr. et al. |
| 6,483,008 | B1 | 11/2002 | Dehesh et al. |
| 6,504,003 | B1 | 1/2003 | Trout et al. |
| 6,583,302 | B1 | 6/2003 | Erhan |
| 6,699,945 | B1 | 3/2004 | Chen et al. |
| 6,770,801 | B2 | 8/2004 | Leto et al. |
| 6,833,341 | B2 | 12/2004 | Machac, Jr. et al. |
| 6,956,155 | B1 | 10/2005 | Martinez-Force et al. |
| 6,974,846 | B2 | 12/2005 | Garrison et al. |

PREPARATION OF SOYBEAN OIL DIESTERS

| | | | |
|---|---|---|---|
| 7,109,392 | B1 | 9/2006 | Broglie et al. |
| 7,122,250 | B2 | 10/2006 | Kinsho et al. |
| 7,205,457 | B1 | 4/2007 | Kishore et al. |
| 7,244,857 | B2 | 7/2007 | Fox et al. |
| 7,423,198 | B2 | 9/2008 | Yao et al. |
| 7,531,718 | B2 | 5/2009 | Fillatti |
| 7,566,813 | B2 | 7/2009 | Voelker et al. |
| 7,589,222 | B2 | 9/2009 | Narayan et al. |
| 7,601,677 | B2 | 10/2009 | Graiver et al. |
| 7,601,888 | B2 | 10/2009 | Fillatti et al. |
| 7,994,354 | B2 | 8/2011 | Benecke et al. |
| 2001/0046549 | A1 | 11/2001 | Sekula et al. |
| 2002/0058774 | A1 | 5/2002 | Kurth |
| 2002/0099229 | A1 | 7/2002 | Martinez Force et al. |
| 2003/0024011 | A1 | 1/2003 | Dehesh et al. |
| 2003/0119686 | A1 | 6/2003 | Machac, Jr. et al. |
| 2003/0172399 | A1 | 9/2003 | Fillatti |
| 2004/0006792 | A1 | 1/2004 | Fillatti et al. |
| 2004/0088758 | A1 | 5/2004 | Martinez Force et al. |
| 2004/0107460 | A1 | 6/2004 | Fillatti et al. |
| 2004/0108219 | A1 | 6/2004 | Matsumura |
| 2005/0010069 | A1 | 1/2005 | Fitchett |
| 2005/0034190 | A9 | 2/2005 | Fillatti et al. |
| 2005/0063939 | A1 | 3/2005 | Ameer et al. |
| 2005/0072964 | A1 | 4/2005 | Rapp |
| 2005/0145312 | A1 | 7/2005 | Herberger, Sr. et al. |
| 2005/0150006 | A1 | 7/2005 | Kodali et al. |
| 2005/0262589 | A1 | 11/2005 | Fillatti |
| 2006/0080750 | A1 | 4/2006 | Fillatti et al. |
| 2006/0135378 | A1* | 6/2006 | Takahashi et al. ..... 508/433 |
| 2006/0194974 | A1 | 8/2006 | Narayan et al. |
| 2006/0199748 | A1 | 9/2006 | Costello et al. |
| 2006/0206963 | A1 | 9/2006 | Voelker et al. |
| 2007/0028328 | A1 | 2/2007 | Brogie et al. |
| 2007/0175793 | A1 | 8/2007 | Narine |
| 2007/0214516 | A1 | 9/2007 | Fillatti et al. |
| 2007/0265459 | A1 | 11/2007 | Suppes |
| 2007/0276165 | A1 | 11/2007 | Gutsche |
| 2008/0021232 | A1 | 1/2008 | Lin |
| 2008/0057552 | A1 | 3/2008 | Lee |
| 2008/0081883 | A1 | 4/2008 | King et al. |
| 2008/0091039 | A1 | 4/2008 | Sleeter |
| 2008/0222756 | A1 | 9/2008 | Fillatti et al. |
| 2008/0248982 | A1 | 10/2008 | Miller et al. |
| 2008/0260933 | A1 | 10/2008 | Thompson et al. |
| 2008/0262259 | A1 | 10/2008 | Luo |
| 2008/0312082 | A1 | 12/2008 | Kinney et al. |
| 2009/0082483 | A1 | 3/2009 | Patrovic et al. |
| 2009/0119805 | A1 | 5/2009 | Fillatti et al. |
| 2009/0202703 | A1 | 8/2009 | Despeghel et al. |
| 2009/0216040 | A1 | 8/2009 | Benecke et al. |
| 2009/0271893 | A1 | 10/2009 | Fillatti |
| 2009/0276911 | A1 | 11/2009 | Despeghel et al. |
| 2010/0029523 | A1 | 2/2010 | Benecke et al. |
| 2011/0269978 | A1 | 11/2011 | Garbark |
| 2011/0269979 | A1 | 11/2011 | Benecke |
| 2011/0269981 | A1 | 11/2011 | Benecke et al. |
| 2011/0269982 | A1 | 11/2011 | Benecke |

FOREIGN PATENT DOCUMENTS

| | | | |
|---|---|---|---|
| CA | 2 748 555 | | 7/2010 |
| CA | 2 748 618 | | 7/2010 |
| DE | 1941522 | | 4/1971 |
| DE | 1 745448 | | 9/1971 |
| EP | 0 128 484 | | 6/1984 |
| EP | 0 351 073 | | 1/1990 |
| EP | 0 420 789 | A1 | 4/1991 |
| EP | 0 555 472 | | 8/1991 |
| EP | 0 571 187 | | 11/1993 |
| EP | 1 978 013 | | 10/2008 |
| ES | 2 381 367 | | 5/2012 |
| JP | S36-004717 | B | 5/1961 |
| JP | S60-209543 | | 5/1961 |
| JP | S57-032245 | A | 2/1982 |
| JP | H01-319458 | A | 12/1989 |
| JP | H03-232839 | | 10/1991 |
| JP | H10-259295 | | 9/1998 |
| JP | 2001-72642 | | 3/2001 |
| JP | 2008-539263 | | 11/2001 |
| JP | 2007-284520 | | 11/2007 |
| JP | 2010-526796 | | 8/2010 |
| WO | 93/02991 | | 2/1993 |
| WO | WO97/40698 | | 11/1997 |
| WO | WO 97/40698 | | 11/1997 |
| WO | WO 03/050081 | | 6/2003 |
| WO | WO03/106599 | | 12/2003 |
| WO | WO 03/106599 | | 12/2003 |
| WO | WO 2004/099227 | | 11/2004 |
| WO | WO 2006/020716 | | 2/2006 |
| WO | WO2006/020716 | | 2/2006 |
| WO | WO 2006020716 | A1 * | 2/2006 |
| WO | WO 2006/093874 | | 9/2006 |
| WO | WO 2006/093877 | | 9/2006 |
| WO | WO2006/094138 | | 9/2006 |
| WO | WO 2006/094138 | | 9/2006 |
| WO | WO2006/116502 | | 11/2006 |
| WO | WO 2006/116502 | | 11/2006 |
| WO | WO 2007/027223 | | 3/2007 |
| WO | WO 2007/041785 | | 4/2007 |
| WO | WO2007/041785 | | 4/2007 |
| WO | WO 2008/124265 | | 10/2008 |
| WO | WO2008/124265 | | 10/2008 |
| WO | WO 2008/130646 | | 10/2008 |
| WO | WO 2008/138892 | | 11/2008 |
| WO | WO 2009/058368 | | 5/2009 |
| WO | WO2009058368 | | 5/2009 |
| WO | WO2009/085033 | | 7/2009 |
| WO | WO 2010/078491 | | 7/2010 |
| WO | WO 2010/078493 | | 7/2010 |
| WO | WO 2010/078498 | | 7/2010 |
| WO | WO 2010/078505 | | 7/2010 |
| WO | WO 2010/104609 | | 9/2010 |
| WO | WO2010104609 | | 9/2010 |
| WO | WO 2011/041476 | | 4/2011 |

OTHER PUBLICATIONS

R. G. Ackman et al., Ozonolysis of Unsaturated Fatty Acids, Can. J. Chem., vol. 39, (1961) pp. 1956/1963.

Petrovic, Zoran S., Polyurethanes from Vegetable Oils, Kansas Polymer Research Center, Pittsburg State University, Pittsburg, USA, Polymer Reviews, 48:109/155, 2008.

Tran, Phuong et al., Ozone/Mediated Polyol Synthesis fromo Soybean Oil, Jacobs Journal of the American Oil Chemists' Society, Sep. 1, 1005, pp. 1/5.

US Office Action dated Feb. 16, 2010 pertaining to U.S. Appl. No. 11/864,043.

International Search Report and Written Opinion dated Jun. 22, 2010 pertaining to international Application No. PCT/US2009/069921.

International Search Report and Written Opinion dated Jun. 10, 2010 pertaining to International Application No. PCT/US2009/069932.

Sparks, Jr. "Oxidation of Lipids in a Supercritical-Fluid Medium" Literature review, reaction of eleic acid with gas oxidants; references chaper III, Mississippi State University, Mississippi US, May 2008, pp. 33-40, 68.

International Search Report and Written Opinion of the International Searching Authority pertaining to international Application No. PCT/US2010/000775, dated Oct. 26, 2010.

EOP Second Examination Report relating to EPO Patent Application No. 06824715.4, dated Feb. 24, 2011.

Extended European Search Report relating to EPO Application No. 10184843.0, dated Mar. 2, 2011.

Office Action pertaining to U.S. Appl. No. 11/864,043, dated Aug. 25, 2010.

J.L. Sebedio et al., Comparison of the Reaction Products of Oleic Acid Ozonized in BC13-, HC1- and BF3-MeOH Media, Chemistry and Physics of Lipids, vol. 35, Jan. 1984, pp. 21-28.

International Search Report and Written Opinion dated Oct. 5, 2010 pertaining to International Application No. PCT/US2009/069909.

International Search Report and Written Opinion dated May 20, 2010 pertaining to International Application No. PCT/US2009/069913.

Zoran S. Petrovic et al., "Structure and Properties of Polyurethanes Prepared From Triglyceride Polyols by Ozonolysis", Biomacromolecules 2005, 6, pp. 713-719.

International Search Report and Written Opinion dated Aug. 2, 2007 pertaining to International Application No. PCT/US2006/016022.
International Search Report and Written Opinion dated Feb. 13, 2007 pertaining to International Application No. PCT/US2005/028428.
Joachim Neumeister, et al. "Ozone Cleavage of Olefins with Formation of Ester Fragments" pp. 939-940.
Castell, J.D., et al., Ozonolysis of unsaturated fatty acids., II. Esterification of the total product form the oxidative decomposition of ozonides with 2,2-dimethoxypropane, 1967, Canadian Journal of Chemistry, vol. 45, No. 13, pp. 1405-1410.
Christie, W., Preparation of Ester derivatives of fatty acids for chromatographic analysis, 1993, Advances in Lipid Methodology—Two, 27 pages.
Database CA [Online] Chemical Abstracts Service, Columbus, Ohio, US; May 12, 1984, Kawai, Kazuyuki et al: "Modified poly(vinyl alcohol)", XP002623365, retrieved from STN Database accession No. 1968:420019; abstract.
Diamond, M.J., et al., Some Chemical Processes utilizing oleic safflower oil, 1970, Journal of the American Oil Chemists' Societ, vol. 47, No. 9, ppl. 362-364.
Notice of Denial issued by the Colombian Patent Office for Colombian Patent Application No. 11-095599, with partial English language translation, dated Jul. 29, 2011.
English Language translation of an Office Action issued by the Japanese Patent Office for JP Patent Application No. 2011-544625, dated Nov. 5, 2013.
First Office Action issued by the State Intellectual Property Office, P.R. China for CN Application No. 200980157518.3, with partial English language translation dated Jul. 1, 2013.
International Search Report and Written Opinion dated May 26, 2011 pertaining to International Application No. PCT/US2010/050803.
Office Action issued by the Canadian Patent Office dated Mar. 27, 2012 relating to App. No. 2,605,527.
Office Action issued by the Colombian Patent Office for Colombian Patent Application No. 11095599, dated Jul. 23, 2013.
Notice of Rejection issued by the Colombian Patent Office for Colombian Patent Application No. 11095599, dated Jan. 17, 2014.
Office Action issued by the Colombian Patent Office for corresponding Colombian Patent App. 11094684, dated Jun. 5, 2013.
Office Action issued by the Colombian Patent Office for corresponding Colombian Patent App. No. 11095603, dated May 14, 2013.
Office Action issued by the Colombian Patent Office for Colombian Patent App. No. 11081839, dated Jul. 16, 2013.
Office Action issued by the European Patent Office for European Patent Application No. 09 797 250.5-1454, dated Nov. 19, 2013.
Office Action issued by the European Patent Office for European Patent Application No. 10 723 809.9 dated Oct. 4, 2012.
Office Action issued by the Indian Patent Office dated Aug. 30, 2011 pertaining to App. No. 4273/KOLNP/2007.
Office Action issued by the Japanese Patent Office dated Jan. 6, 2014 relating to Application No. 2011-554054.
Office Action issued by the Japanese Patent Office dated Mar. 13, 2012 relating to App. No. 2008-509117.
Office Action issued by the Korean Patent Office dated May 21, 2012 (preliminary rejection, no references cited) pertaining to App. No. 10-2007-7027534.
Office Action issued by the Mexican Patent Office for corresponding Mexican Patent App. No. Mx/a/2011/007001 dated Oct. 7, 2013.
Second Office Action issued by the State Intellectual Property Office, P.R. China for CN Application No. 200980157518.3, with partial English language translation dated Mar. 21, 2014.
Office Action issued by the Mexican Patent Office for corresponding Mexican Patent App. No. Mx/a/2011/007002 dated Apr. 15, 2014.
Office Action issued by the Japanese Patent Office for corresponding JP Patent App. No. 2011-544625 dated May 23, 2014.
Office Action issued by the Malaysian Patent Office for corresponding MY PI 2011003058 dated May 30, 2014.
Office Action issue by the Chilean Patent Office for Corresponding CL Patent Application No. 01628-2011, dated Jun. 6, 2014, with English language summary.
Office Action issue by the Chilean Patent Office for Corresponding CL Patent Application No. 01626-2011, dated Jun. 6, 2014, with English language summary.
Office Action issued by the Canadian Patent Office dated Jul. 8, 2014 relating to App. No. 2,748,622.
Extended Search Report issued by the European Patent Office dated Oct. 8, 2014 relating to App. No. 14177736.7.

* cited by examiner

*Primary Examiner* — Taiwo Oladapo
(74) *Attorney, Agent, or Firm* — Greer, Burns & Crain, Ltd.

(57) ABSTRACT

Lubricants based on renewable feedstocks and methods of making them.

16 Claims, 2 Drawing Sheets

PREPARATION OF SOYBEAN OIL MONOESTERS

MODIFIED VEGETABLE OIL LUBRICANTS

Lubricants derived from renewable feedstocks such as animal or vegetable oils or fats would be desirable to help reduce the dependence of the United States on foreign oil. Lubricating oils based on renewable sources such as vegetable and animal oils and fats have a number of advantages. The vegetable and animal oils or fats contain triglycerides having ester carbonyl groups. The polar nature of these ester carbonyl groups leads to strong adsorption on metal faces as a very thin film so that the film forming properties of triglyceride based lubricants are particularly advantageous in hydraulic systems. Vegetable oils and animal oils typically have high viscosity indices that facilitate their use over wide temperature ranges. Furthermore, they typically have high fume points (e.g., about 200° C.) and high flash points (e.g., about 300° C.).

In addition, vegetable and animal oil and fat based lubricants help reduce the depletion of fossil-derived hydrocarbons. Moreover, vegetable oil based lubricants are typically biodegradable, which would help reduce the introduction of waste lubricants into the environment. Currently, about 50% of mineral lubricants used worldwide end up in landfills and the like.

However, there are major problems in using oils from renewable feedstocks such as plant oils, (i.e. soybean oils and other vegetable oils), or oils or fats derived from animal sources, (e.g. menhaden, lard, butterfat and other animal derived oils) as lubricants, including: (1) low oxidative stability; (2) relatively low viscosities; and (3) tendencies to solidify at low operating temperatures as manifested by relatively high pour points (temperatures below which they will no longer pour).

Therefore, there is a need for a lubricant based on a renewable feedstock that could be modified to provide the desired properties.

Figure 1:
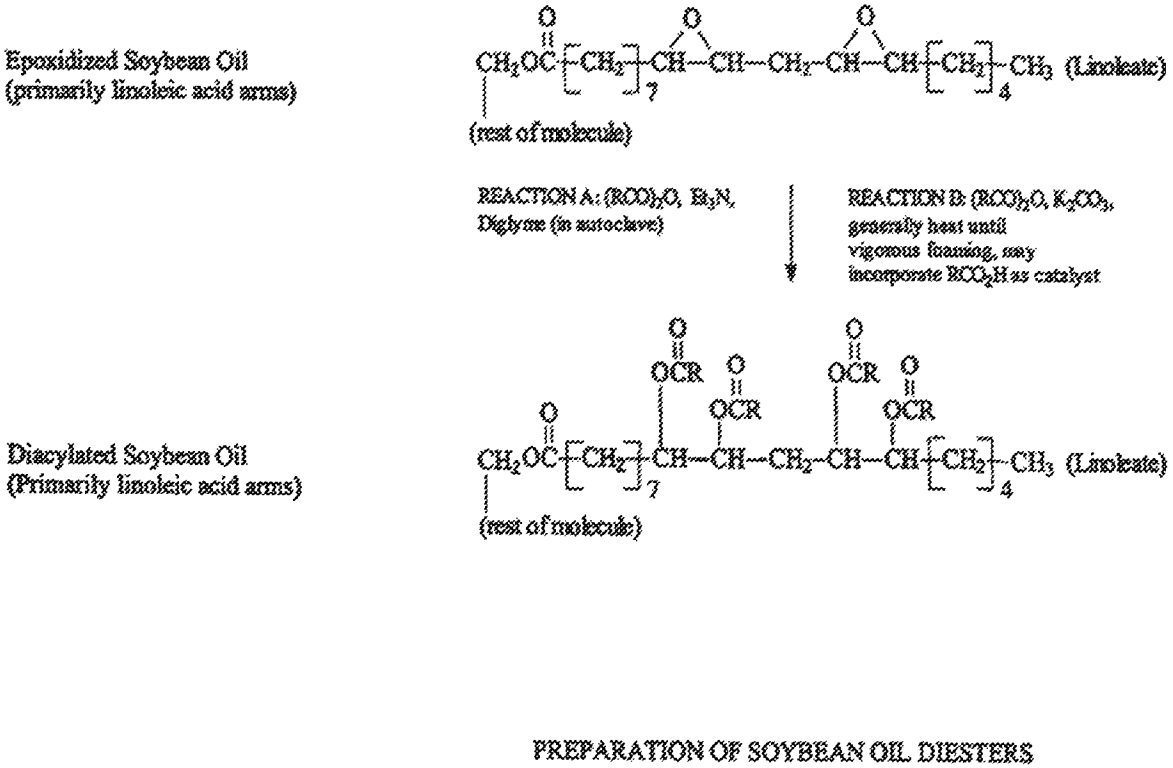
FIG. 1 illustrates two general routes for the preparation of vegetable or animal oil or fat diesters. The illustration specifically shows the preparation of soybean oil diesters from soybean oil via epoxidized soybean oil by epoxide addition reactions.

One aspect of the invention is a method for producing a lubricant. The method includes forming a backbone modified monoester or diester of a fatty acid of a modified biobased oil by: a) esterifying a hydrogenated epoxidized fatty acid of the modified biobased oil with a carboxylic acid, an acid anhydride, or an acid chloride to form the monoester; or b) esterifying an epoxidized fatty acid of the modified biobased oil with a carboxylic acid anhydride to form the diester; or c) reacting an epoxidized fatty acid of the modified biobased oil with a carboxylic acid to form a beta ester alcohol, and reacting the beta ester alcohol with a second carboxylic acid, an acid anhydride, or an acid chloride to form the diester; or d) hydrolyzing an epoxidized fatty acid of the modified biobased oil to a diol and reacting the diol with a carboxylic acid, an acid anhydride, or an acid chloride to form the diester; wherein the backbone modified monoester or diester of the fatty acid of the modified biobased oil is esterified with 2-butanol, 1,2-propylene glycol, 2-methyl-1,3-propane diol, 1,1,1-(trimethylol)propane, 2,2-bis(hydroxymethyl)propane or neopentyl glycol; and wherein the modified biobased oil has a high oleic composition, a mid-oleic composition, a 90% oleic composition, a high linoleic composition, or a low saturated composition.

The backbone modified monoester or diester can incorporate an acid group selected from $C_2$-$C_{18}$ carboxylic acids. The acid group can include, but is not limited to, acetic acid, propanoic acid, butyric acid, isobutyric acid, 2-ethylbutanoic acid, hexanoic acid, 2-ethylhexanoic acid, nonanoic acid, decanoic acid, lauric acid, myristic acid, palmitic acid, oleic acid, stearic acid, or combinations thereof.

The reaction can take place in the presence of a catalyst. Suitable catalysts for the esterification of the hydrogenated epoxidized fatty acid of the modified biobased oil with a carboxylic acid are tin salts, hypophosphite salts such as sodium hypophosphite, or acids such as sulfuric acid, whereas pyridine or 4-dimethylaminopyridine are suitable for use with acid anhydrides and acid chlorides. Suitable catalysts for the hydrogenation of the epoxidized fatty acid are transition metals such as palladium deposited on carbon. Suitable catalysts for reacting an epoxidized fatty acid of the modified biobased oil with an acid anhydride are metal carbonates with or without carboxylic acids, or tertiary amines such triethylamine. Suitable catalysts for reacting an epoxidized fatty acid of the modified biobased oil with a carboxylic acid to form a beta ester alcohol are quaternary salts and imidazoles. Suitable catalysts for reacting the beta ester alcohol with a second carboxylic acid are tin salts, hypophosphite salts such as sodium hypophosphite, or acids such as sulfuric acid, whereas pyridine or 4-dimethylaminopyridine are suitable for use with an acid anhydride or an acid chloride to form the diester. Suitable catalysts for hydrolyzing an epoxidized fatty acid of the modified biobased oil to a diol are cupric salts. Suitable catalysts for reacting the diol with a carboxylic acid are tin salts, hypophosphite salts such as sodium hypophosphite, or acids such as sulfuric acid, whereas pyridine or 4-dimethylaminopyridine are suitable for reaction with an acid anhydride or an acid chloride to form the diester.

One or more functional components can be added to the monoester or diester if desired. Suitable functional components include pour point depressants, anti-wear additives, base stock, diluent, extreme pressure additives, and antioxidants.

The monoester and diester can be made using a mixture of carboxylic acids. When reacting an epoxidized fatty acid of the modified biobased oil with a carboxylic acid to form a beta ester alcohol, and reacting the beta ester alcohol with a second carboxylic acid, the carboxylic acids can be the same or different.

Another aspect of the invention is a lubricant composition. The lubricant composition includes a mixture of one or more of a backbone modified monoester or diester of a fatty acid of a modified biobased oil: a) a monoester product of a reaction of a hydrogenated epoxidized fatty acid of a modified biobased oil with a carboxylic acid, an acid anhydride or an acid chloride; or b) a diester product of a reaction of an epoxidized fatty acid of a modified biobased oil with a carboxylic acid anhydride; or c) a diester product of a reaction of a beta ester alcohol with a second carboxylic acid, an acid anhydride, or an acid chloride, the beta ester alcohol being the reaction product of an epoxidized fatty acid with a first carboxylic acid; or d) a diester product of a reaction of a diol with a carboxylic acid, an acid anhydride, or an acid chloride, the diol being a hydrolyzed product of an epoxidized fatty acid; the backbone modified monoester or diester fatty acid of the modified biobased oil being esterified with 2-butanol, 1,2-propylene glycol, or 2-methyl-1,3-propane diol, 1,1,1-(trimethylol)propane, 2,2-bis(hydroxymethyl)propane or neopentyl glycol; and the modified biobased oil having a high oleic composition, a mid-oleic composition, a 90% oleic composition, a high linoleic composition, or a low saturated composition.

The lubricant composition can have a pour point of less than about −10° C. in the absence of an added pour point depressant, or less than −15° C., or less than −20° C., or less than −25° C., or less than −30° C., or less than −35° C.

Another aspect of the invention is a lubricant composition comprising a mixture of one or more of a backbone modified monoester or diester of a fatty acid of a modified biobased oil having a formula (derived from oleic acid and linoleic acid) as shown below:

Backbone
Oleic acid
monoester:

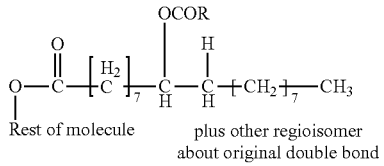

Backbone
Linoleic acid
monoester

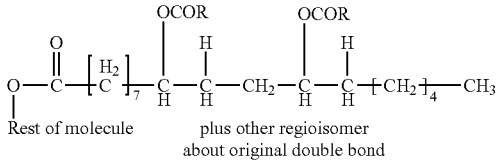

Backbone
Oleic acid
diester:

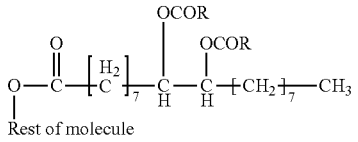

Backbone
Linoleic acid
diester

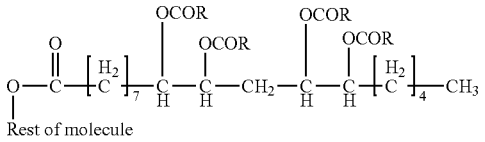

wherein the backbone modified monoester or diester fatty acid of the modified biobased oil is esterified with 2-butanol, 1,2-propylene glycol, 2-methyl-1,3-propane diol, 1,1,1-(trimethylol)propane, 2,2-bis(hydroxymethyl)propane or neopentyl glycol; and wherein the modified biobased oil has a high oleic composition, a mid-oleic composition, a 90% oleic composition, a high linoleic composition, or a low saturated composition; and where R' and R includes alkyl groups varying from $C_1$-$C_{17}$, cycloalkyl groups, aromatic groups, heterocyclic groups and mixtures thereof including a combination of different alkyl groups of different chain lengths within the same molecule, and wherein each R' may be the same or different and each R may be the same or different.

The terms oils and fats are relative terms that are used interchangeably herein. Where the term oil is used, it also includes fats and vice versa. Also, the oils and fats can be derived from either vegetables, or animals, or combinations thereof.

A typical renewable feedstock oil is represented by soybean oil. Soybean oil is a desirable oil because it is readily available and relatively low cost. For ease of discussion, the term soybean oil will be used in this application. However, it is to be understood that the invention is not limited to soybean oil, and includes any vegetable or animal oils or fats.

Individual vegetable oils, including soybean oil, are triglycerides that contain characteristic quantities of individual fatty acids that are randomly distributed among these triglyceride structures. A typical soybean oil composition contains the following fatty acid composition (all percentages are weight %): 54% linoleic acid (doubly unsaturated), 23% oleic acid (mono unsaturated), 8% linolenic acid (triply unsaturated), 11% palmitic acid, and 4% stearic acid (both saturated).

The triglyceride structure can be modified to increase the oxidative stability of oil, as described in WO 2006/020716, filed Aug. 10, 2005, entitled Lubricants Derived From Plant and Animal Oils and Fats, which claims the benefit of U.S. Provisional Application Ser. No. 60/600,346 filed Aug. 10, 2004, which is incorporated herein by reference.

The oxidative instabilities of animal and vegetable oils result from attack of oxygen at the activated methylene groups flanking their numerous double bonds (e.g. soybean oil has approximately 4.7 double bonds per soybean triglyceride molecule). Methylene groups flanked by two double bonds, as found in linoleic and linolenic acids, are particularly vulnerable. One approach to improve these oils as lubricants is to add large quantities of various antioxidants to overcome their oxidative instability. On the other hand, modification or removal of these double bonds in the oils by processes such as hydrogenation significantly improves their oxidative stabilities, but also leads to undesirable and very significant increases in pour points.

The double bonds in animal and vegetable oils and their derivatives are modified in a manner that significantly increases their oxidative stabilities while maintaining, and in some cases improving upon, their pour points and viscosity profiles. Accordingly, a number of structurally diverse lubricant samples were prepared by the methods shown in FIGS. 1 and 2. In these figures "rest of molecule" refers to the rest of generalized triglycerides in a soy oil that typically contain a variety of fatty acids such as linoleic, oleic, linolenic and other fatty acids. The unsaturated fatty acids in the triglycerides are typically converted to diester or monoester derivatives. A method to overcome hydrolytic and thermal attack is to incorporate sterically hindered ester groups into the modified triglyceride. Typical examples of sterically hindering ester groups include isobutyrate and 2-ethylhexanoate.

While allylic methylene groups in triglyceride fatty acids such as oleic and especially doubly allylic methylene groups in triglyceride fatty acids such as linoleic and linolenic acids are susceptible to oxidation, this tendency is overcome by either adding two ester groups, (to form disesters) or adding an ester and a hydrogen atom (to form monoesters) to essentially all of the double bonds of triglyceride unsaturated fatty acids. The specific orientation of such ester groups is such that an oxygen atom is attached directly to a carbon atom that originally was a component of a fatty acid double bond and a carbonyl group is attached to such oxygen atom. In addition to having enhanced oxidative stabilities, some of these derivatives may be characterized as advantageously having decreased pour points, increased responsiveness to pour point depressants, and increased (or a minimized decrease in) viscosity indices.

Referring now to FIG. 1, this figure shows one embodiment of the invention where epoxidized soybean oil is represented in the figure by an epoxidized linoleic fatty acid arm (since linoleic acid is the major fatty acid in soybean triglycerides). Other epoxide structures in these triglycerides can be derived from oleic and linolenic acid.

Referring to FIG. 1, in Reaction A, in summary, epoxidized soybean oil, an acid anhydride $\{(RCO)_2O\}$, a tertiary amine such as triethylamine and diethyleneglycol dimethyl ether (diglyme) are heated in an autoclave for typically 15-20 hours to obtain soybean oil diesters. The same reaction would work for epoxidized propylene glycol disoyate, epoxidized methyl soyate, or other epoxidized fatty acid esters. In FIG. 1, reaction B, in summary, epoxidized soybean oil, an acid anhydride -$\{(RCO)_2O\}$-, and anhydrous potassium carbonate are heated at temperatures up to approximately 210° C. until all epoxide functionality is consumed as indicated by proton nuclear magnetic resonance spectroscopy. In some cases, cessation of vigorous foaming indicates that this reaction is at or near completion. This reaction is expected to be applicable when the R group increases in size. Reactions A and B have both been used to prepare soybean oil diesters where R varies from $C_1$ to $C_{17}$. The same reaction would work for epoxidized propylene glycol disoyate or epoxidized methyl soyate, or other epoxidized fatty acid esters.

Figure 2:
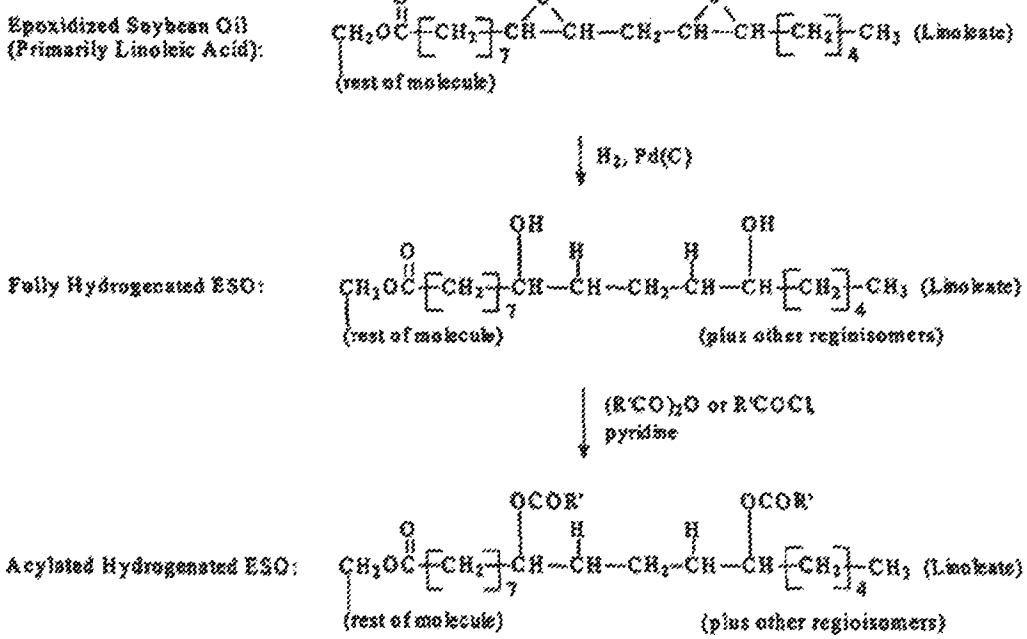
FIG. 2 illustrates a general route for the preparation of vegetable or animal oil or fat monoesters. The illustration specifically shows the preparation of soybean oil monoesters from soybean oil via epoxidized soybean oil by hydrogenation and acylation reactions.

The generalized approach shown in FIG. 2 involves the initial reduction of epoxidized soybean oil with typically hydrogen in the presence of a Pd(C), Pd $(Al_2O_2)$, Raney nickel or other hydrogenation catalysts. The hydrogenated material is then reacted by acetylation of the hydroxylated arms. As shown in FIG. 2, the hydrogenated epoxidized soybean oil is typically reacted with acylating agents such as acid anhydrides $\{(R'CO)_2O\}$ or acid chlorides (R'COCL) in the presence of acylating catalysts such as pyridine or hydrogen chloride traps such as triethylamine to obtain the end product. The same reaction sequence would work for epoxidized propylene glycol disoyate, epoxidized methyl soyate, or other epoxidized fatty acid esters.

The term "other regioisomers" in FIG. 2 refers to the analogous structures resulting from the orientation of the hydrogen atom and the ester groups with reference to each other. In other words, each pair of ester groups and hydrogen atams can have the orientations shown in FIG. 2 or either or both can be exchanged with each other.

In WO 2006/020716, soybean oil was reacted to form monoesters or diesters. However, whereas the viscosities of those materials were applicable as basestocks for greases and also for rock drilling fluids, the viscosities were generally too high for use in other high volume lubricant applications such as engine oils and hydraulic fluids.

One method of modifying the properties of a lubricant made from soybean oil is to modify the fatty acid composition of the oil. Soybean oil can be conveniently modified by crop breeding or genetic engineering of the soybean plant. Alternatively, different oils and/or fatty acids can be blended to obtain the desired amounts of the fatty acids in the oil.

We have found that by varying the amounts of the different fatty acids, the properties of the oil can be beneficially modified. We have discovered that lowering the amount of saturated acids (e.g., the palmitic and/or stearic acids) will lower the pour point of the oil. Also, increasing the amount of linoleic acid and/or linolenic acid will increase the viscosity of the oil and can increase the oil pour points. Conversely, increasing the amount of oleic acid will reduce the viscosity of the oil and generally reduces the oil pour points.

Recent work has shown that the fatty acid composition of palm oil can be modified by breeding and genetic manipulation to obtain high levels of oleic acid in the 50-85% range. Palm oil with high oleic acid and very low linoleic and linolenic fatty acid contents would be an ideal candidate for the modifications described herein.

Table 1 shows the fatty acid composition of various soybean based oils having a range of individual fatty acids compositions. It can be seen that both low saturate and high linoleic have a lower saturated fatty acid level than normal saturate and these changes are mainly balanced by increased linoleic content. The linoleic content in high linoleic soybean oil is in the 55-65% range, and the saturated fatty acid content in low saturate and high linoleic soybean oil is in the 4-12% range. Mid oleic, high oleic and 90% oleic contain increasing amounts of oleic acid and these changes are mainly balanced by reductions in both linoleic and linolenic acids. The oleic content in low saturate soybean oil is about the same as in normal saturate soy bean oil. The oleic content in mid oleic acid soybean oil is in the 40-70% range, the oleic content in high oleic soybean oil is in the 70-85% range, and the oleic content in 90% oleic acid is in the 85-95% range Various embodiments of the present invention are directed to converting soybean oil into oxidatively stable oils that also have acceptable pour points or are amenable to pour point lowering by addition of appropriate pour point depressants. The general approach involves addition of ester functionality across the double bonds of soybean oil triglyceride fatty acids as well as the double bonds of soybean oil-derived fatty acids that are esterified with other polyols or monools to significantly improve the oxidative stability of the original allylic and doubly allylic methylene groups. To accomplish this effect, chemistries that result in addition of one ester group and one hydrogen across all double bonds (Backbone Monoesters) as well as the addition of two ester groups across all double bonds (Backbone Diesters) are used as shown below (showing the structures derived from linoleic acid and oleic acid but understood to include analogous structures derived from linolenic acids):

Backbone
Oleic acid
monoester:

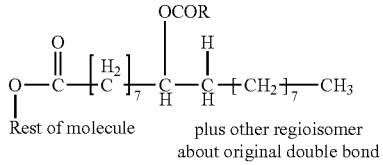

Backbone
Linoleic acid
monoester

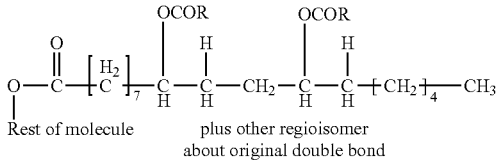

Backbone
Oleic acid
diester:

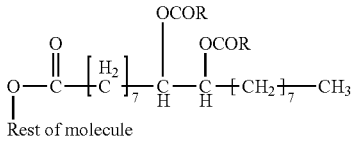

-continued

Backbone
Linoleic acid
diester

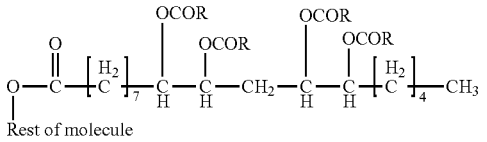

The ester groups along the backbone in both monoesters and diesters are expected to cause these materials to exhibit stronger binding to metal surfaces and higher lubricity than the corresponding fatty acid derivative.

Backbone modified "monoesters" of soy bean oil and backbone modified fatty acid esters of polyols and monools were prepared by hydrogenation of the corresponding epoxidized derivative followed by acylation reactions with carboxylic acids, acid anhydrides or acid chlorides. The corresponding backbone modified "diesters" can be prepared by three general methods. One involves the acylation of the corresponding epoxidized derivatives with carboxylic acid anyhydrides in the presence of either basic salts such as potassium bicarbonate or tertiary amines. Another involves the reaction of epoxidized derivatives to form beta ester alcohols that are then esterified with a second carboxylic acid, acid anhydrides or acid chlorides. Still another involves the hydrolysis of epoxidized derivatives to form beta dialcohols that are then esterified with carboxylic acids, acid anhydrides or acid chlorides.

The following examples are intended to be illustrative of the invention and are not meant to limit the scope of the invention in any way.

EXAMPLE 1

This example shows the typical procedure for epoxidation of olefinic fatty acid or fatty acid esters.

150.10 g mid-oleic soybean oil was reacted with 52 g 50% hydrogen peroxide in the presence of 9.69 g formic acid. The epoxidation was performed at 55° C. for 4 hours. The mixture was dissolved into 600 mL diethyl ether and partitioned with 150 mL of saturated sodium bicarbonate in a separatory funnel followed by two washes of 150 mL water. The organic layer was then dried with magnesium sulfate and filtered. The resulting solution was initially evaporated on a rotary evaporator and a short path distillation apparatus (a Kugelrohr apparatus) was used to vacuum distill any remaining solvent at 30° C. and 0.20 Torr. The final oil product (155.93 g) was shown to be the epoxidized mid-oleic soybean oil as analyzed by $^1$H NMR.

EXAMPLE 2

This example shows the typical procedure for esterification of fatty acids.

90.27 g 90% oleic acid was reacted with 48.75 g 2-butanol in the presence of 0.67 g p-toluene sulfonic acid using 200 mL toluene as solvent. The reaction was performed using Fischer esterification conditions. The mixture was partitioned with 100 mL of 10% wt/wt potassium carbonate in a separatory. The organic layer was then dried with magnesium sulfate and filtered. The resulting solution was initially evaporated on a rotary evaporator and a short path distillation apparatus (a Kugelrohr apparatus) was used to vacuum distill the remaining solvent. The final oil product (99.30 g) was shown to be the 2-butyl oleate as analyzed by $^1$H NMR.

EXAMPLE 3

This example shows another typical procedure for esterification of fatty acids.

190.44 g normal saturate soybean oil fatty acid was reacted with 30.01 g 2-methyl-1,3-propane diol in the presence of 5.60 g sodium hypophosphite as the esterification catalyst. The reaction was heated at 220° C. for 3 hours followed by heat at 220° C. with aspirator vacuum for 4 hours. The mixture was dissolved into ethyl acetate and partitioned with 10% wt/wt potassium hydroxide in a separatory followed by two water washes. The organic layer was then dried with magnesium sulfate and filtered through celite. The resulting oil and small amounts of solid were dissolved into hexane and filtered. The resulting solution was initially evaporated on a rotary evaporator and a short path distillation apparatus (a Kugelrohr apparatus) was used to vacuum distill the remaining solvent at 90° C. and 0.10 Torr. The final oil product (167.65 g) was shown to be the 2-methyl-1,3-propane diol disoyate as analyzed by $^1$H NMR.

EXAMPLE 4

This example shows a typical procedure for the hydrogenation of an epoxidized fatty acid or fatty acid esters.

168.66 g epoxidized normal saturate propylene glycol disoyate (EPGDS) was reacted with hydrogen in the presence of 50.50 g 5% palladium on alumina catalyst using 900 mL ethanol as solvent. The reaction was run at ambient temperature at 60 psi until all epoxide was gone by $^1$H NMR. The mixture was filtered through celite and rinsed with dichloromethane. The resulting solution was initially evaporated on a rotary evaporator and a short path distillation apparatus (a Kugelrohr apparatus) was used to vacuum distill the remaining solvent. The final oil product (144.46 g) was shown to be the mono-hydroxylated propylene glycol disoyate as analyzed by $^1$H NMR.

EXAMPLE 5

This example shows a typical procedure for making the mono-ester lubricant from the mono-hydroxylated fatty acid or fatty acid ester.

138.27 g mono-hydroxylated mid-oleic soybean oil was reacted with 85.21 g hexanoyl chloride in the presence of 61.3 mL pyridine using 550 mL diethyl ether as solvent. The hexanoyl chloride was added dropwise to the reactor containing the oil, pyridine, and solvent at 10° C. using an ice bath to maintain temperature. Once addition was complete, the water bath was removed and the mixture was refluxed for 3 hours. The cloudy mixture was then filtered and solvent removed by rotary evaporator. The remaining hazy oil was then dissolved into ethyl acetate and partition with aqueous hydroxide, followed by aqueous acid, followed by aqueous bicarbonate, and finally water. The organic layer was dried using magnesium sulfate followed by filtration. The resulting solution was initially evaporated on a rotary evaporator and a short path distillation apparatus (a Kugelrohr apparatus) was used to vacuum distill the remaining solvent. The final oil product (175.20 g) was shown to be the mono-hexanoate ester of mid-oleic soybean oil as analyzed by $^1$H NMR.

EXAMPLE 6

This example shows a typical procedure for making the di-ester lubricant from the epoxidized fatty acid or fatty acid ester.

100.03 g epoxidized 2-methyl-1,3-propane diol disoyate (MePGDS) was reacted with 138.00 g hexanoic anhydride in the presence of 2.85 g hexanoic acid using 6.86 g potassium carbonate as catalyst. The hexanoic anhydride, hexanoic acid, and MePGDS were heated in a flask with stirring to 180° C. The potassium carbonate was then added to the mixture and temperature maintained for 1.5 hours. The reaction was shown to be complete by $^1$H NMR. The mixture was dissolved into 1 L ethyl acetate and partitioned with aqueous hydroxide, followed by aqueous acid, followed by aqueous bicarbonate, and finally water. The organic layer was dried using magnesium sulfate followed by filtration. The resulting solution was initially evaporated on a rotary evaporator and a short path distillation apparatus (a Kugelrohr apparatus) was used to vacuum distill the remaining solvent. The final oil product (177.35 g) was shown to be the di-hexanoate ester of epoxidized 2-methyl-1,3-propane diol disoyate as analyzed by $^1$H NMR.

EXAMPLE 7

This example shows another typical procedure for making the di-ester lubricant from the epoxidized fatty acid or fatty acid ester.

100.01 g epoxidized propylene glycol disoyate (EPGDS) was reacted with 257.18 g hexanoic anhydride in the presence of 2.32 g hexanoic acid using 5.53 g potassium carbonate as catalyst. The hexanoic anhydride, hexanoic acid, and EPGDS were heated in a flask with stirring to 130° C. The potassium carbonate was then added to the mixture and temperature maintained for 11 hours. The reaction was shown to be complete by $^1$H NMR. The mixture was dissolved into 600 mL ethyl acetate and partitioned with aqueous hydroxide, followed by aqueous acid, followed by aqueous bicarbonate, and finally water. The organic layer was dried using magnesium sulfate followed by filtration. The resulting solution was initially evaporated on a rotary evaporator and a short path distillation apparatus (a Kugelrohr apparatus) was used to vacuum distill the remaining solvent. The final oil product (130.67 g) was shown to be the di-hexanoate ester of epoxidized propylene glycol disoyate as analyzed by $^1$H NMR.

EXAMPLE 8

This example illustrates the hydrolysis of an epoxidized fatty acid ester to form a di-alcohol derivative to be used to produce a backbone modified diester of a modified biobased oil.

20.03 g epoxidized 2-methyl-1,3-propylene glycol di-high oleic soyate (E2-MePGDHOS) was reacted with 2.16 g water in the presence of 175 mL tetrahydrofuran using 0.32 g copper(II) tetrafluoroborate monohydrate as catalyst. The mixture was stirred at 60° C. for 108.5 hours at which time the reaction was shown to be 96% complete by $^1$H NMR. The solvent was evaporated on a rotary evaporator, and remaining quantities of water were removed azeotropically by distillation using 3×150 mL portions of toluene. The mixture was then dissolved into 200 mL ethyl acetate and dried using magnesium sulfate followed by filtration. The resulting solution was initially evaporated on a rotary evaporator, and a short path distillation apparatus (a Kugelrohr apparatus) was used to vacuum distil the remaining solvent. The final oil product (21.33 g) was shown to be the di-hydroxyl derivative of 2-methyl-1,3-propylene glycol di-high oleic soyate as analyzed by $^1$H NMR.

EXAMPLE 9

This example illustrates the method that will be used to esterify the dihydroxylated product from example 8 to produce a backbone modified diester of a modified biobased oil.

Di-hydroxyl 2-methyl-1,3-propylene glycol di-high oleic soyate will be reacted with hexanoic acid (1.05 eq) in the presence of 0.04% by weight tin (II) oxide as catalyst with stirring at 200° C. until all hydroxyl groups are esterified. The product will then be dissolved into ethyl acetate and partitioned with aqueous carbonate followed by washing with water. The organic layer will then be dried using a desiccant such magnesium sulfate. The filtered solution will be purified by initially evaporating on a rotary evaporator and further purified on a short path distillation apparatus (a Kugelrohr apparatus) under reduced pressure to remove traces of solvent. The final oil product can then be used as lubricant and will analyzed by $^1$H NMR.

EXAMPLE 10

This example illustrates the method that will be used to convert a compositionally modified epoxidized fatty acid derivative to a beta-hydroxy ester that will be esterified further to form a backbone modified diester of a modified biobased oil while using two different esters to form the diester.

Hexanoic acid (1.05 equivalent) will be reacted with epoxidized 2-methyl-1,3-propane diol disoyate (of high oleic soybean oil) in the presence of about 3 weight percent 2-methyl imidazole (compared to hexanoic acid) used as an epoxide ring opening catalyst to form the corresponding beta-hydroxy ester. This reaction will optimally be performed without solvent at a temperature of about 100° C. and will be continued until almost all epoxide functionality has been reacted as indicated by $^1$H NMR spectroscopy. Optionally, the 2-methyl imidazole can be removed by dissolving the product in a water-insoluble solvent and then contacting with an aqueous acidic solution (preferably 5% hydrochloric acid). This solution would be washed with water, dried, and the solvent would be completely stripped by distillation approaches This intermediate will be esterified with a second carboxylic acid nonanoic acid by reacting with 1.05 equivalents of nonanoyl chloride in the presence of pyridine in a solvent such as diethyl ether to prepare the backbone modified diester. The precipitate of pyridine hydrochloride will be filtered, and the solvent will be removed by distillation. The product will be dissolved in ethyl acetate and extracted with aqueous sodium hydroxide, followed by aqueous acid, followed by aqueous bicarbonate, and finally water. The organic layer will be dried over a desiccant, and the solvent will be removed by distillation. The structure of the final product will be ascertained by $^1$H NMR spectroscopy.

Table 2-4 show the results of tests on the properties of the various oils in Examples 1-7.

Table 2 shows dihexanoate ester and monohexanoate ester lubricants from 1,2-propylene glycol (PG) disoyate. Crystallization onset temperatures (COTs) were measured for all samples, and it was generally determined that COTs correlate with pour point values. A comparison of samples 1 and 3 illustrates that the high oleic composition of 1,2-propylene glycol disoyate dihexanoate had lower viscosity, lower crystallization onset temperature, and lower pour point (no pour point for sample 3) compared to 1,2-propylene glycol disoyate hexanoate from the normal oil candidate. A comparison of samples 3 and 5 show the beneficial effect of 2-methyl-1,3-propane diol compared to 1,2-propylene glycol functionalized fatty acid esters in that lower pour points were obtained with the 2-methyl-1,3-propane diol derived compounds. A comparison of samples 3 and 6 shows that increased linoleic acid and decreased saturated fatty acid results in increased viscosities and decreased pour points. A comparison of samples 7 and 8 shows the effect of 1,2-propylene glycol compared with triglyceride functionalized fatty acid esters, whereby the 1,2-propylene glycol ester has an appreciably decreased viscosity but an increased pour point.

Table 3 shows dihexanoate ester lubricants from alkyl soyate ester. A comparison of sample 1 and 2 illustrates the lower viscosity and lower crystallization onset temperatures due to the high oleic composition in 2-butyl fatty acid esters. A comparison of sample 2 and 3 illustrates the lower viscosity and lower crystallization onset temperatures due to 2-butyl soyate esters versus 2-ethylhexyl soyate esters.

Table 4 shows diester and monoester lubricants from soybean oil triglyceride. A comparison of samples 2 and 1 illustrates the lower viscosity achieved with mid-oleic compared with normal saturation soybean fatty acids. A comparison of samples 3 and 1 illustrates increased viscosity for low saturate soybean oil due to decreased saturated fatty acids and increased linoleic acid concentration. A comparison of samples 5 and 4 again illustrates increased viscosity for decreased saturated fatty acids and increased linoleic acid concentration. A comparison of samples 7 and 8 illustrates decreased viscosity achieved with mid-oleic compared with normal saturation soybean fatty acids.

While the forms of the invention herein disclosed constitute presently preferred embodiments, many others are possible. It is not intended herein to mention all of the possible equivalent forms or ramifications of the invention. It is to be understood that the terms used herein are merely descriptive, rather than limiting, and that various changes may be made without departing from the spirit of the scope of the invention.

TABLE 1

Various Soybean Oil Fatty Acid Compositions

| | Fatty Acid % Weights | | | |
|---|---|---|---|---|
| Soybean Oil Description | Oleic | Linoleic | Linoleic | Saturates |
| Normal Saturate | 22.7 | 52.9 | 8.0 | 16.4 |
| Low Saturate | 22.2 | 60.1 | 8.6 | 9.1 |
| High Linoleic | 25.0 | 60.0 | 9.0 | 6.0 |
| Mid Oleic | 53.3 | 31.1 | 1.0 | 14.6 |
| High Oleic | 80.0 | 3.0 | 3.0 | 12.0 |
| 90% Oleic | 90.5 | 1.0 | 0.5 | 8.0 |

TABLE 2

Dihexanoate Ester and Monohexanoate Ester Lubricants from 1,2-Propylene Glycol (PG) Disoyate

| | Dihexanoates | | | | | | | | | | |
|---|---|---|---|---|---|---|---|---|---|---|---|
| | 1 | 2 | 3 | 4 | 5 | 6 | | | | | |
| Sample Description | 52014-43-25 90% Oleic | 52340-27-14 90% Oleic Modified Process | 52014-38-33 Normal Saturate | 52340-17-30 Normal Saturate Modified Process | 52336-18-25 Normal Saturate 2-Methyl-1,3-PG | 52014-42-3 High Linoleic | SAE 5W-20 | SAE 10W-30 | SAE 10W-40 | SAE 20W-50 | SAE 50 |
| Viscosity cSt | | | | | | | | | | | |
| at 40 C. | 89.9 | 78.0 | 232 | 137.1 | 221 | 285 | 45.9 | 69.74 | 95.41 | 165.9 | 222.10 |
| at 100 C. | 11.8 | 12.1 | 20.79 | 16.3 | 23.6 | 24.74 | 8.36 | 10.67 | 14 | 18.5 | 20.36 |
| VI = | 124 | 153 | 105 | 127 | 132 | 111 | 160 | 141 | 151 | 125 | 107 |
| Cryst on set C. | <−50 | <−50 | −7.02 | −9.28 | −10.88 | <−50 | | | | | |
| Pour Points C. | −39 | −34 | −12 | −3 | −21 | −21 | −36 | −33 | −33 | −27 | −18 |

| | Monohexanoates | |
|---|---|---|
| | 7 | 8 |
| Sample Description | 52336-10-19 Normal Saturate | 49703-69-9 Normal Saturate Triglyceride |
| Viscosity cSt | | |
| at 40 C. | 82.3 | 210.5 |
| at 100 C. | 13.04 | 25.28 |
| VI = | 160 | 151 |
| Cryst on set C. | −4.88, −36.40 | |
| Pour Points C. | −6 | −15 |

(a) Reaction performed with increased equivalents anhydride at lower reaction temperatures as seen in Example 7

1 vs 3 illustrates lower viscosity, lower COTs, and lower pour points due to high oleic composition 2 vs 1 and 4 vs 3 illustrates the effect of higher equivalents and lower temperature during reaction 5 vs 3 illustrates the beneficial effect of 2-methyl-1,3-propate diol versus 1,2-propylene glycol functionalized fatty acid esters 6 vs 3 illustrates the effect of lower saturate soybean oil; increased viscosity and decreased pour point 7 vs 8 illustrates the effects 1,2-propylene glycol versus triglyceride functionalized fatty acid esters; decreased viscosity but increased pour points

TABLE 3

| Dihexanoate Ester Lubricants from Alkyl Soyate Ester | | | | | |
|---|---|---|---|---|---|
| | 1 | 2 | 3 | | |
| Sample | 52014-35-33 | 52014-36-32 | 52014-20-33 | SAE | SAE |
| Description | 2-Butyl Ester 90% Oleic | 2-Butyl Ester Normal Saturate | 2-EthylHexyl Normal Saturate | 5W-20 | 10W |
| Viscosity cSt | | | | | |
| at 40 C. | 22.2 | 32.9 | 50.8 | 45.9 | 38.7 |
| at 100 C. | 4.57 | 6.02 | 7.4 | 8.36 | 6.5 |
| VI = | 123 | 130 | 107 | 160 | 120 |
| Cryst on set C. | −28.8 | −17.4 | −14.7 | | |
| Pour Points C. | −24 | −16 | | −36 | −33 |

1 vs 2 illustrates lower viscosity and lower COT's due to high oleic composition in 2-butyl fatty acid esters
2 vs 3 illustrates lower viscosity and lower COT's due to 2-butyl soyate esters versus 2-ethylhexyl soyate esters

TABLE 4

| Diester and Monoester Lubricants from Soybean Oil Triglyceride | | | | | |
|---|---|---|---|---|---|
| | Dihexanoates | | | Succinic/Isobutyrate | |
| | 1 | 2 | 3 | 4 | 5 |
| Description | Normal Saturate | Mid-Oleic | Low Saturate | Normal Saturate | Low Saturate |
| Viscosity cSt | | | | | |
| at 40 C. | 398 | 349.4 | 601 | 2674 | 4714 |
| at 100 C. | 36.2 | 33.59 | 47.6 | 94 | 125 |
| VI = | 134 | 137 | 132 | 97 | 91 |
| Cryst on set C. | | | | | |
| Pour Points C. | −21 | −21 | −21 | 2 | 3 |

| | Monohexanoates | |
|---|---|---|
| | 7 | 8 |
| Sample | 52336-5-29 | 49703-69-9 |
| Description | Mid-Oleic | Normal Saturate |
| Viscosity cSt | | |
| at40C | 136.8 | 210.5 |
| at 100C | 17.89 | 25.28 |
| VI = | 145 | 151 |
| Cryst on set C | −12.38, −25.73 | |
| Pour Points C | | −15 |

2 vs 1 illustrates lower viscosity achieved with mid-oleic vs normal saturate soybean fatty acids
3 vs 1 illustrates increased viscosity low saturate soybean oil due to increased linoleic acid concentration
5 vs 4 again illustrates increased viscosity low saturate soybean oil due to increased linoleic acid concentration
7 vs 8 illustrates lower viscosity achieved with mid-oleic vs normal saturate soybean fatty acids

The invention claimed is:

1. A method for producing a lubricant comprising:

forming a backbone modified diester of a biobased fatty acid by:

a) esterifying an epoxidized biobased fatty acid with a carboxylic acid anhydride to form the diester; or b) reacting an epoxidized biobased fatty acid with a carboxylic acid to form a beta ester alcohol, and reacting the beta ester alcohol with a second carboxylic acid, an acid anhydride, or an acid chloride to form the diester; or c) hydrolyzing an epoxidized biobased fatty acid to a diol and reacting the diol with a carboxylic acid, an acid anhydride, or an acid chloride to form the diester;

wherein the backbone modified diester of the biobased fatty acid is esterified with 2-butanol, 1,2-propylene glycol, 2-methyl-1,3-propane diol, 1,1,1-(trimethylol)propane, or neopentyl glycol;

the biobased fatty acid content being high oleic with an oleic content in a range of 70-85 wt %, mid oleic with an oleic content in a range of 40-70 wt %, an oleic content in a range of 85-95 wt %, a linoleic content in a range of 55-65 wt %, or a saturated fatty acid content in a range of 4-12 wt %;

wherein the esterified backbone modified diester of the biobased fatty acid has a viscosity of 4.57 to 24.74 cSt at 100° C.

2. The method of claim 1 wherein the backbone modified diester incorporates an acid group selected from $C_2$-$C_{18}$ carboxylic acids.

3. The method of claim 2 wherein the acid group is acetic acid, propanoic acid, butyric acid, isobutyric acid, 2-ethylbutanoic acid, hexanoic acid, 2-ethylhexanoic acid, nonanoic acid, decanoic acid, lauric acid, myristic acid, palmitic acid, oleic acid, stearic acid, or combinations thereof.

4. The method of claim 1 wherein the reaction takes place in the presence of a catalyst.

5. The method of claim 1 further comprising adding one or more functional components to the diester, the functional components selected from pour point depressants, anti-wear additives, diluent, extreme pressure additives, and antioxidants.

6. The method of claim 1 wherein a mixture of carboxylic acids are used.

7. A lubricant composition comprising a mixture of one or more of a backbone modified diester of a biobased fatty acid:

a) a diester product of a reaction of an epoxidized biobased fatty acid with a carboxylic acid anhydride; or b) a diester product of a reaction of a beta ester alcohol with a second carboxylic acid, an acid anhydride, or an acid chloride, the beta ester alcohol being the reaction product of an epoxidized biobased fatty acid with a first carboxylic acid; or c) a diester product of a reaction of a diol with a carboxylic acid, an acid anhydride, or an acid chloride, the diol being a hydrolyzed product of an epoxidized biobased fatty acid;

the backbone modified diester of the biobased fatty acid being esterified with 2-butanol, 1,2-propylene glycol, 2-methyl-1,3-propane diol, 1,1,1-(trimethylol)propane, or neopentyl glycol; and the biobased fatty acid content being high oleic with an oleic content in a range of 70-85 wt %, mid oleic with an oleic content in a range of 40-70 wt %, an oleic content in a range of 85-95 wt %, a linoleic content in a range of 55-65 wt %, or a saturated fatty acid content in a range of 4-12 wt %;

wherein the esterified backbone modified diester of the biobased fatty acid has a viscosity of 4.57 to 24.74 cSt at 100° C.

8. The lubricant composition of claim 7 wherein the backbone modified diester incorporates an acid group selected from $C_2$-$C_{18}$ carboxylic acids.

9. The lubricant composition of claim 8 wherein the acid group is acetic acid, propanoic acid, butyric acid, isobutyric acid, 2-ethylbutanoic acid, hexanoic acid, 2-ethylhexanoic acid, nonanoic acid, decanoic acid, lauric acid, myristic acid, palmitic acid, oleic acid, stearic acid, or combinations thereof.

10. The lubricant composition of claim 7 wherein the lubricant composition has a pour point of less than about −10° C. in the absence of an added pour point depressant.

11. The lubricant composition of claim 7 further comprising one or more functional components selected from pour point depressants, anti-wear additives, diluent, extreme pressure additives, and antioxidants.

12. A lubricant composition comprising a mixture of one or more backbone modified diester of a biobased fatty acid having a formula:

Backbone
Oleic acid
monoester:

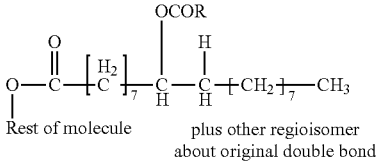

-continued

Backbone
Linoleic acid
monoester

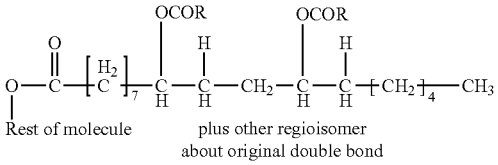

Backbone
Oleic acid
diester:

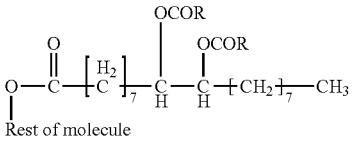

Backbone
Linoleic acid
diester

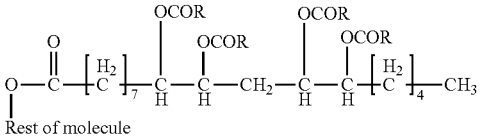

wherein the backbone modified diester of the biobased fatty acid of the modified biobased oil is esterified with 2-butanol, 1,2-propylene glycol, or 2-methyl-1,3-propane diol; and the biobased fatty acid content being high oleic with an oleic content in a range of 70-85 wt %, mid oleic with an oleic content in a range of 40-70 wt %, an oleic content in a range of 85-95 wt %, a linoleic content in a range of 55-65 wt %, or a saturated fatty acid content in a range of 4-12 wt %; and where R' and R includes alkyl groups varying from $C_1$-$C_{17}$, cycloalkyl groups, aromatic groups, heterocyclic groups and mixtures thereof including a combination of different alkyl groups of different chain lengths within the same molecule, and wherein each R' may be the same or different and each R may be the same or different, wherein the esterified backbone modified diester of the biobased fatty acid has a viscosity of 4.57 to 24.74 cSt at 100° C.

13. The lubricant composition of claim 12 wherein the backbone modified diester incorporates an acid group selected from $C_2$-$C_{18}$ carboxylic acids.

14. The lubricant composition of claim 13 wherein the acid group is acid, propanoic acid, butyric acid, isobutyric acid, 2-ethylbutanoic acid, hexanoic acid, 2-ethylhexanoic acid, nonanoic acid, decanoic acid, lauric acid, myristic acid, palmitic acid, oleic acid, stearic acid, or combinations thereof.

15. The lubricant composition of claim 12 wherein the lubricant composition has a pour point of less than about −10° C. in the absence of an added pour point depressant.

16. The lubricant composition of claim 12 further comprising one or more functional components selected from pour point depressants, anti-wear additives, diluent, extreme pressure additives, and antioxidants.

* * * * *